US012751520B2

(12) United States Patent
Picco

(10) Patent No.: US 12,751,520 B2
(45) Date of Patent: Oct. 6, 2026

(54) ARTICLE OF FOOTWEAR WITH DYNAMIC BANKING SOLE STRUCTURE

(71) Applicant: NIKE, Inc., Beaverton, OR (US)

(72) Inventor: Bryan Picco, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/407,032

(22) Filed: Dec. 3, 2025

(65) Prior Publication Data

US 2026/0223985 A1 Aug. 6, 2026

Related U.S. Application Data

(60) Provisional application No. 63/754,724, filed on Feb. 6, 2025.

(51) Int. Cl.

| | |
|---|---|
| ***A43B 13/18*** | (2006.01) |
| ***A43B 7/24*** | (2006.01) |
| ***A43B 13/20*** | (2006.01) |

(52) U.S. Cl.

CPC ..... *A43B 13/18* (2013.01); *A43B 7/24* (2013.01); *A43B 13/20* (2013.01)

(58) Field of Classification Search

CPC ..... A43B 13/18; A43B 13/20; A43B 7/24
USPC ..... 36/29, 142, 143, 144
See application file for complete search history.

(56) References Cited

U.S. PATENT DOCUMENTS

| | | | | |
|---|---|---|---|---|
| 4,364,189 A | | 12/1982 | Bates | |
| RE34,102 E | * | 10/1992 | Cole | A43B 13/203 36/35 B |
| 8,387,278 B2 | * | 3/2013 | Rees | A43B 13/143 36/103 |
| 8,424,221 B2 | * | 4/2013 | Litchfield | A43B 21/285 36/35 B |
| 11,633,010 B2 | * | 4/2023 | Bowman | A43B 3/0042 36/29 |
| 2003/0217484 A1 | * | 11/2003 | Christensen | A43B 13/203 36/29 |
| 2004/0040183 A1 | | 3/2004 | Kerrigan | |
| 2005/0108897 A1 | | 5/2005 | Aveni | |
| 2010/0251567 A1 | * | 10/2010 | McInnis | A43B 3/34 36/35 B |

(Continued)

FOREIGN PATENT DOCUMENTS

CN 111107761 A 5/2020

*Primary Examiner* — Marie D Bays
(74) *Attorney, Agent, or Firm* — Quinn IP Law

(57) ABSTRACT

A sole structure includes a midsole having a lateral side defining a lateral edge and a medial side defining a medial edge. The midsole includes a first zone extending from the lateral edge toward the medial side and having a substantially uniform thickness, and a second zone extending from the medial edge toward the first zone and having a tapered thickness that decreases toward the medial edge. A resilient cushioning member extends across a portion of both the first zone and the second zone of the midsole in at least a forefoot region of the sole structure. The resilient cushioning member is substantially inset within the midsole in the first zone, it protrudes increasingly from the midsole in the second zone as the tapered thickness decreases toward the medial side, and maintains a substantially planar configuration when unloaded and permits controlled medial deformation when laterally loaded.

20 Claims, 4 Drawing Sheets

(56) References Cited

U.S. PATENT DOCUMENTS

| | | | | |
|---|---|---|---|---|
| 2011/0072684 | A1* | 3/2011 | Stubblefield | A43B 13/122 36/28 |
| 2012/0174432 | A1* | 7/2012 | Peyton | A43B 13/125 36/31 |
| 2013/0067764 | A1* | 3/2013 | Riddle | A43B 7/1464 36/31 |
| 2013/0167402 | A1* | 7/2013 | Christensen | A43B 13/184 36/29 |
| 2014/0075778 | A1* | 3/2014 | Bruce | A43B 7/1445 36/29 |
| 2020/0359742 | A1* | 11/2020 | Campos, II | A43B 13/186 |
| 2021/0169174 | A1* | 6/2021 | Campos, II | A43B 13/186 |
| 2021/0195996 | A1* | 7/2021 | Chan | A43B 13/186 |
| 2023/0404210 | A1* | 12/2023 | Connell | A43B 13/20 |
| 2024/0032650 | A1* | 2/2024 | Connell | A43B 13/187 |
| 2024/0180291 | A1* | 6/2024 | Andrews | A43B 13/20 |

* cited by examiner

ARTICLE OF FOOTWEAR WITH DYNAMIC BANKING SOLE STRUCTURE

CROSS REFERENCE TO RELATED APPLICATIONS

The present application claims the benefit of priority from U.S. Provisional Patent No. 63/754,724, filed 6 Feb. 2025, which is incorporated by reference in its entirety.

TECHNICAL FIELD

The present disclosure relates generally to footwear, and more particularly to sole structures for athletic footwear that provide dynamic support characteristics responsive to different movement patterns.

BACKGROUND

Athletic footwear design faces an inherent challenge in balancing stability requirements across different types of movement. While most sports involve some combination of straight-line running and lateral movements, basketball magnifies this engineering problem due to its constant transitions between full-speed sprints and explosive directional changes.

During straight-line running and acceleration, athletes require a stable, neutral platform that promotes natural foot mechanics and efficient energy transfer. This neutral platform is essential for maintaining proper biomechanical alignment from the foot through the ankle, knee, and hip. However, basketball also includes explosive lateral movements that occur during direction changes, defensive slides, and offensive cuts. These movements generate substantial lateral forces that require enhanced support structures.

Traditional approaches typically fall into one of two categories: designs that prioritize straight-line stability but provide limited lateral support, or designs that enhance lateral movement capability and stability but may require biomechanical adaptations during linear motion. The impact extends beyond immediate performance effects, as athletes may modify their movement or body positioning to compensate for footwear limitations. This can lead to suboptimal performance and/or an increased risk of injury.

While these tradeoffs are present in footwear design for most sports, the challenges are particularly acute in basketball footwear design, where rapid transitions between movement patterns create complex and competing demands on sole structure performance characteristics.

BRIEF DESCRIPTION OF THE DRAWINGS

FIG. 3A shows the sole structure in a neutral position during straight-line running;

FIG. 3B shows initial banking engagement during lateral movement initiation; and FIG. 3C shows full banking engagement at maximum lateral loading.

FIG. 4A shows a first embodiment optimized for increased banking response;

FIG. 4B shows a second embodiment balancing stability and banking response; and FIG. 4C shows a third embodiment optimized for increased stability.

DETAILED DESCRIPTION

Figure 1:
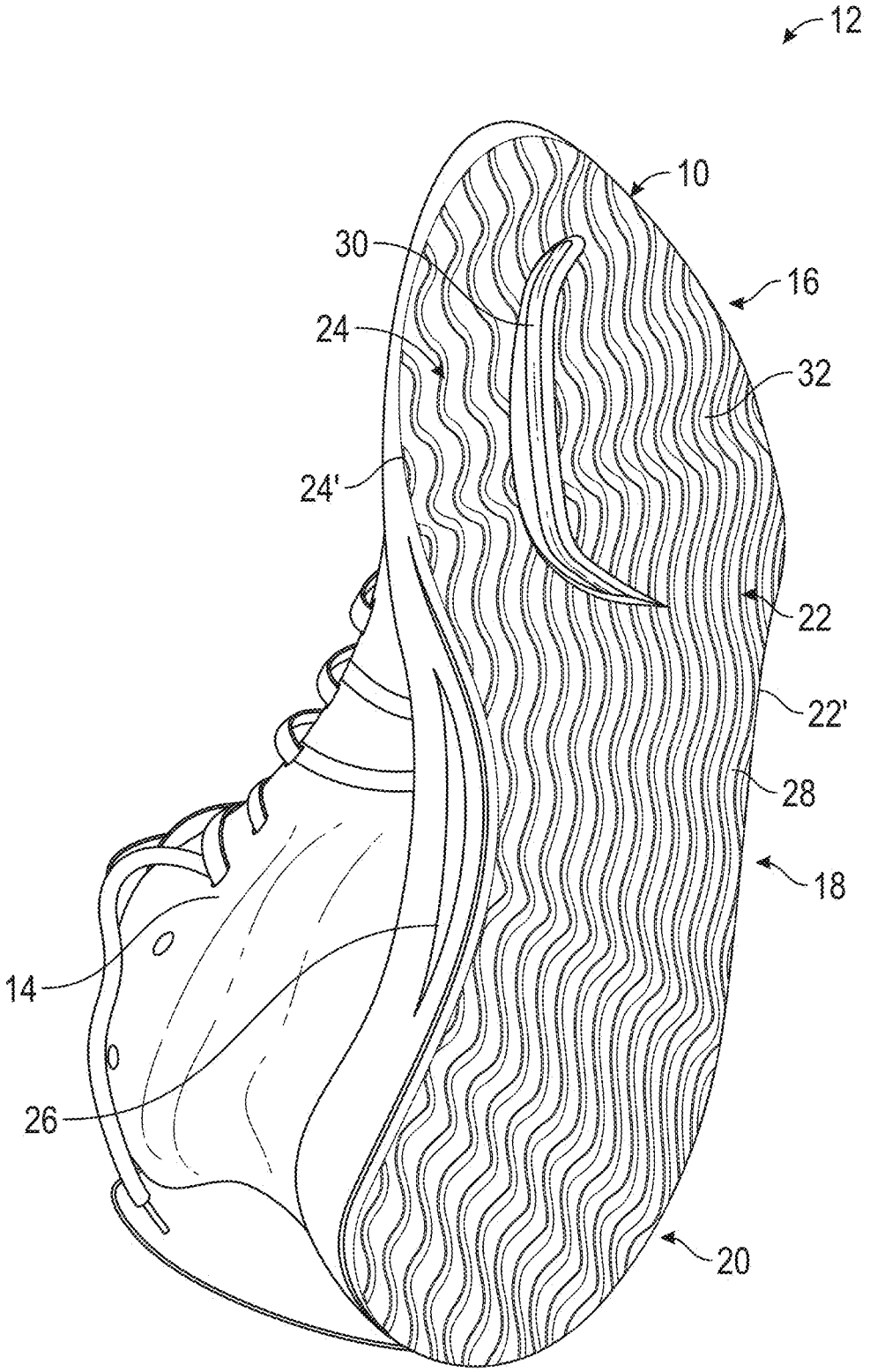
FIG. 1 is a schematic perspective view of an embodiment of an article of footwear incorporating a sole structure with dynamic banking capabilities.

The present disclosure provides a sole structure for athletic footwear that dynamically adapts to different movement patterns through a combination of geometric and mechanical elements. Like a racetrack that remains flat on straightaways but banks through turns, this sole structure maintains a neutral platform during linear movement while providing beneficial banking support during lateral transitions.

The sole structure achieves this dynamic response through the coordinated interaction of a unique midsole geometry along with a resilient cushioning member that spans differently profiled functional zones of the midsole. In this design, the midsole includes a uniform-thickness portion extending from the lateral side and a tapered portion extending from the medial side. The resilient cushioning member spans across both portions and, due to the tapering medial geometry, transitions from being substantially inset within the midsole at the lateral side to protruding prominently beyond the midsole material at the medial side. This geometric arrangement enables the resilient cushioning member to maintain a substantially planar configuration during straight-ahead loading while permitting the protruding medial portion to compress against the ground surface during lateral movements, creating a functional banking effect.

The geometric arrangement of the tapered portion may be adapted to achieve different performance characteristics. For example, an asymmetric tapering profile that extends further toward the lateral side in the forefoot region compared to the midfoot region may enhance banking response during cutting movements while maintaining stability during acceleration. Similarly, varying the extent of the tapered region along the length of the sole can create zones of progressively increasing banking sensitivity. Such variations in the geometry enable the sole structure to be tuned for specific movement patterns while maintaining the fundamental principles of the dynamic banking mechanism.

The present sole structure design overcomes historical compromises in basketball footwear design by providing appropriate support for each movement pattern. During straight-line running, the sole structure maintains a neutral platform that promotes natural biomechanics and efficient energy transfer. When an athlete initiates a lateral cutting movement, the sole progressively develops a functional banking angle that better aligns with the resultant force vectors, enhancing both performance and stability during directional changes.

The system achieves these performance characteristics without complex mechanical components or additional structures. Instead, it relies on carefully engineered geometric relationships and material properties that create naturally adaptive behavior based on applied forces. This approach maintains manufacturing feasibility while providing consistent performance throughout the footwear's lifecycle.

While described primarily in the context of basketball footwear, the present invention may be implemented in various athletic footwear applications requiring both straight-line and lateral stability. Alternative embodiments may include different resilient cushioning member configurations, differing boundary geometries for the tapered portion, and/or various and modified taper profiles to optimize performance for specific sports or movement patterns.

Referring to the figures where like numbers are used to identify similar components in the various views, FIG. 1 generally illustrates a sole structure 10 for an article of footwear 12 that provides dynamic banking functionality through a unique combination of geometric and material properties. This sole structure 10 enables selective engagement of banking support during lateral movements while maintaining a neutral position during straight-line motion. During straight-line running, the sole structure 10 provides a stable platform that promotes natural foot mechanics. However, when an athlete executes a cutting movement, the sole structure 10 includes a structurally induced compliance that permits a controlled, inward-tilting banking angle and enhances support and performance during the lateral transition.

The article of footwear 12 generally includes an upper 14 and the sole structure 10 secured to the upper 14 to define a void for receiving a wearer's foot. For purposes of reference, the article of footwear 12 may be divided into three general regions: a forefoot region 16 generally including portions of the article of footwear 12 corresponding with the toes and joints connecting the metatarsal bones with the proximal phalanges; a midfoot region 18 generally including portions corresponding with the arch; and a heel region 20 generally corresponding with rear portions including the calcaneus bone. The article of footwear 12 also includes a lateral side 22 and a medial side 24 extending through each of the forefoot region 16, midfoot region 18, and heel region 20. The lateral side 22 generally corresponds with the outside of the foot (i.e., the side that faces away from the other foot), and the medial side 24 corresponds with the inside of the foot (i.e., the side that faces toward the other foot). For reference, each of the lateral side 22 and medial side 24 include a respective edge (i.e., the lateral edge 22' and medial edge 24', respectively) which refers to the outer periphery of the sole structure on that respective side when viewed in plan or normal to the outward-facing (ground-contacting) surface of the sole structure. The forefoot region 16, midfoot region 18, heel region 20, lateral side 22, and medial side 24 are not intended to demarcate precise areas but rather provide general areas for reference during the following discussion.

The sole structure 10 may include both a midsole 26 and an outsole 28. The midsole 26 attaches to a lower portion of the upper 14 and provides cushioning and stability for the wearer's foot. The outsole 28 attaches to a lower surface of the midsole 26 and provides the primary ground-engaging surface of the article of footwear 12. The outsole 28 may be formed from durable, wear-resistant materials that provide both durability and traction. In some embodiments, the outsole 28 may simply be a skin or ruggedized outward facing surface of the midsole 26 and need not be separately formed or formed from a differing material from the midsole 26.

Figure 2A:
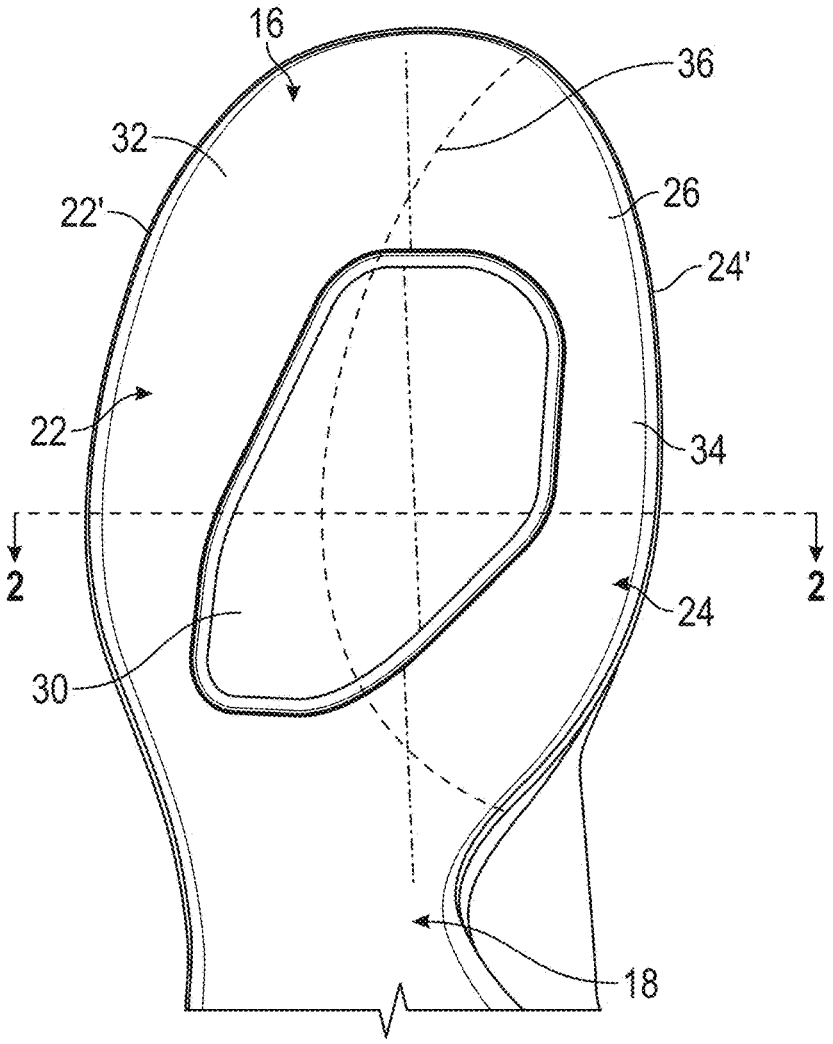
FIG. 2A is a schematic plan view of an embodiment of a sole structure of an article of footwear with dynamic banking capabilities.
Figure 2B:
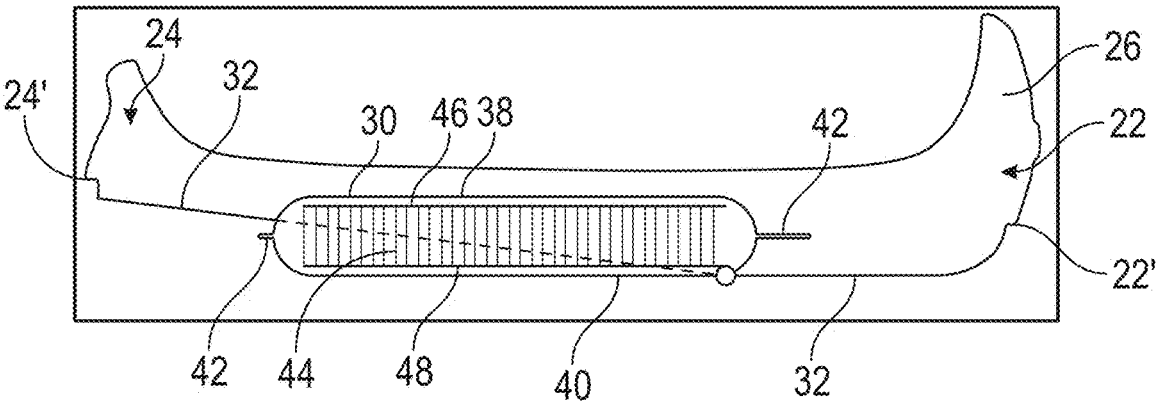
FIG. 2B is a schematic cross-sectional view of an embodiment of the sole structure of FIG. 2A, taken along line 2-2.

As better illustrated in FIGS. 2A and 2B, the forefoot region 16 of the sole structure 10 is specifically configured to achieve the dynamic banking response through a carefully engineered geometric relationship between the midsole 26 and resilient cushioning member 30. More specifically, within the forefoot region 16, the midsole 26 incorporates distinct geometric zones that create controlled deformation characteristics during specific dynamic movements of the wearer.

As shown, within the forefoot region 16, the midsole 26 includes a first zone 32 extending from the lateral edge 22' toward the medial side 24 of the sole structure 10. This first zone 32 is characterized by a substantially uniform thickness that provides stability during straight-line movement. A second zone 34 generally extends from the medial edge 24' toward the lateral side 22 and is defined by a continuous perimeter or boundary 36. In the embodiment shown, this boundary 36 may have an arcuate geometry that begins at the medial edge 24', extends laterally beyond the longitudinal midline 60 to reach an apex, after which it returns to the medial edge 24'. Within this second zone 34, the midsole 26 incorporates a tapered thickness that decreases as it progresses toward the medial edge 24'. When viewed perpendicular to the longitudinal midline 60, the taper may have a taper angle that can be measured relative to an average outer surface of the first zone 32 (or else measured relative to the ground when the shoe is upright and positioned such that the outer surface is in contact with the ground). In some embodiments, the taper angle may be constant across the entire longitudinal dimension of the second zone 34. In other embodiments, the taper angle may be a varying taper angle, that, for example, has a greater angle in a central region and shallower taper angles on opposite forward and rear sides of the central region. It has been found that taper angles in the range of from about 5 degrees to about 9 degrees produce the desired dynamic banking effect, however it is believed that shallower and/or more aggressive tapers may also be used. In one particular embodiment, the taper angle may be a constant taper angle of about 7 degrees across the entire longitudinal dimension of the second zone 34.

As further illustrated in FIGS. 2A and 2B, the resilient cushioning member 30 is positioned to extend across portions of both the first zone 32 and second zone 34 of the midsole 26 to create a continuous cushioning element that adapts to varying loading conditions. As shown in FIG. 2B, the resilient cushioning member 30 comprises a sealed chamber formed between first and second polymeric sheets 38, 40 bonded together at a peripheral flange 42 to define an interior cavity containing a pressurized fluid. A plurality of tensile elements 44 may span between the first and second polymeric sheets 38, 40 to further connect the sheets while allowing controlled separation under pressure. In certain embodiments, the tensile elements 44 may include a first tensile layer 46 secured to an interior surface of the first polymeric sheet 38, a second tensile layer 48 secured to an interior surface of the second polymeric sheet 40, and a plurality of tensile members 50 extending between and connecting the first and second tensile layers 46, 48. The tensile elements 44 may be formed as a unitary, one-piece textile element having a spacer-knit textile configuration. During operation, the tensile elements 44 operatively restrain separation of the first and second polymeric sheets 38, 40 under inflation pressure while allowing controlled deformation when lateral forces are applied. During some loading conditions, the tensile elements 44 may go slack in proportion to applied forces, enabling precise control of the banking angle development.

The resilient cushioning member 30 may be secured within the midsole 26 according to various construction arrangements and may be located within at least the forefoot region 16 (i.e., where lateral cutting movements and contact pressures are most pronounced during basketball play). In some embodiments, the resilient cushioning member 30 may be at least partially inset or encased by midsole material in the forefoot region 16. Likewise, in some embodiments, the outsole 28 may cover both the midsole 26 and portions of the resilient cushioning member 30 in the forefoot region 16.

While the resilient cushioning member 30 may span at least a portion of the first zone 32 and second zone 34, the vertical positioning of the resilient cushioning member 30 (i.e., positioning relative to the thickness of the midsole 26) varies systematically across the width of the sole structure 10. In the first zone 32, the resilient cushioning member 30 may be substantially inset within the midsole 26 such that the outer surface of the midsole material extends about flush with or slightly outward of the resilient cushioning member 30. As used herein, "about flush" is intended to permit some minor variance, where the outer profile of the resilient cushioning member 30 may be fully inset or may be recognizable when the sole is viewed. In either case, however, the substantial majority of the resilient cushioning member 30 is inset into the midsole 26 within the first zone 32. As the sole structure 10 transitions into the second zone 34, the tapered thickness of the midsole 26 results in the resilient cushioning member 30 becoming progressively more prominent relative to the surrounding midsole material. This configuration creates a medially-increasing exposure of the resilient cushioning member 30, wherein the resilient cushioning member 30 extends increasingly proud of the surrounding midsole material approaching the medial edge 24'.

As generally illustrated in FIG. 1, in some embodiments, the outsole 28 may be continuous across both the first zone 32 of the midsole 26 and the resilient cushioning member 30, while the outsole 28 may be split or separated from the second zone 34 to accommodate the increased prominence of the resilient cushioning member 30 where it extends beyond the midsole material. The systematic variation in resilient cushioning member exposure corresponds to the tapering profile of the second zone 34, establishing a geometric relationship that enables controlled deformation under lateral loading while maintaining the substantially planar configuration of the resilient cushioning member 30 during neutral loading conditions.

Figure 3A:
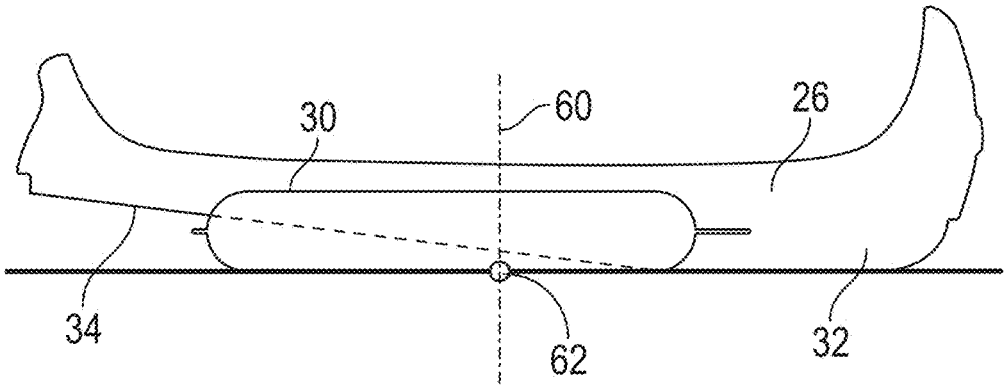
FIGS. 3A-3C are sequential schematic cross-sectional views showing the dynamic response of the sole structure during different loading conditions; more particularly.
Figure 3B:
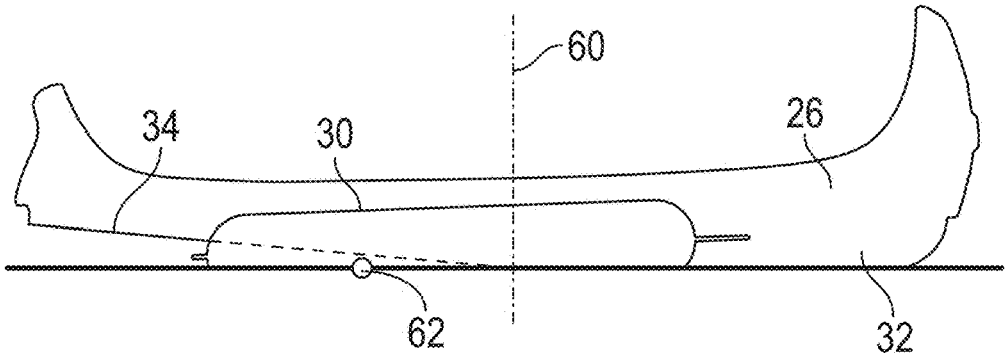
Figure 3C:
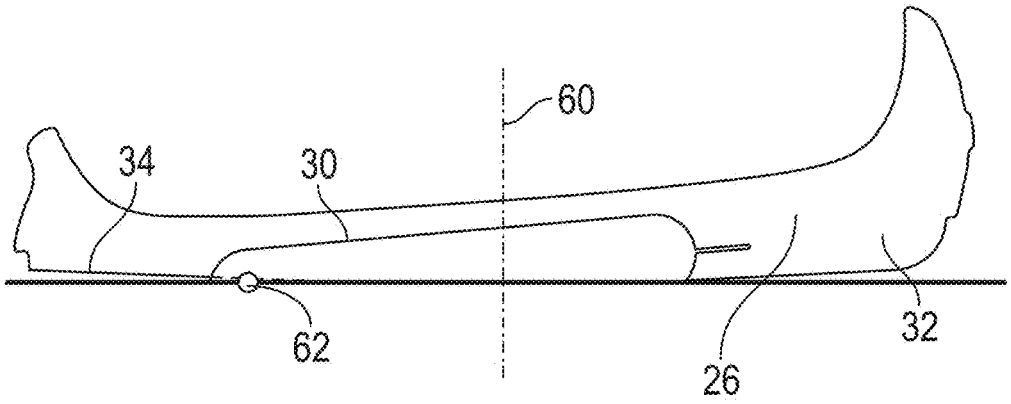

The dynamic nature of the system's response is illustrated in the sequence shown in FIGS. 3A-3C. During straight-line running (FIG. 3A), the resilient cushioning member 30 maintains its substantially planar configuration through the balanced interaction of internal pressure forces and tensile element 44 constraint, providing a stable platform for linear movement. As an athlete initiates a lateral cutting movement (FIG. 3B), forces and weight of the wearer begin to shift medially, which results in a controlled deformation of the resilient cushioning member 30 in the region overlying the second zone 34 of the midsole 26. At the apex of the cutting movement (FIG. 3C), the system achieves a functional banking angle through the combined deformation of the resilient cushioning member 30 and with additional support provided by the contact of the tapered geometry of the second zone 34 against the ground.

As appreciated from the sequence illustrated in FIGS. 3A-3C, the sole structure 10 achieves its dynamic banking functionality without mechanical complexity or additional components beyond the engineered, medially-tapering midsole geometry and the spanning resilient cushioning member 30. The system takes advantage of the natural tendency of the pressurized fluid-filled chamber to maintain a planar configuration when evenly loaded, while allowing controlled deformation when lateral forces are applied. This provides enhanced support during cutting movements without compromising straight-line performance or introducing unnecessary weight or complexity to the sole structure 10.

The functional banking angle developed during lateral movement is controlled by the geometric relationship between the first zone 32 and second zone 34 of the midsole 26, as well as the structural characteristics of the resilient cushioning member 30. This combination of features enables the sole structure 10 to provide appropriate support for both linear and lateral movements while maintaining manufacturing feasibility and long-term durability.

Midsole Architecture

The midsole 26 incorporates a carefully engineered zonal architecture that enables dynamic banking functionality through strategic division of its structure into distinct yet integrated regions. The first zone 32 serves as the primary stability zone, extending from the lateral edge 22' generally toward a longitudinal midline 60 of the sole structure 10. This zone maintains a substantially uniform thickness throughout its extent, which promotes natural gait mechanics and stability during straight-line movement.

The second zone 34 of the midsole 26 provides a tapered outer contour that progressively thins from near the first zone 32 toward the medial edge 24'. Within the tapered portion of the second zone 34, the outer surface of the midsole 26 may have a contour that forms an angle of between about 5 degrees and about 9 degrees relative to the outer surface of the midsole within the first zone 32, when measured in a plane perpendicular to the longitudinal midline 60. In one particular embodiment, the contour of the outer surface of the midsole forms an angle of about 7 degrees relative to the outer surface of the midsole within the first zone 32.

The second zone 34 is defined by a continuous boundary 36 that begins and ends at the medial edge 24' while extending to or laterally beyond the longitudinal midline 60, creating a region where the midsole material has been removed to achieve the desired taper profile. In one embodiment, this boundary 36 may have an arcuate geometry, however, other continuous boundary shapes may also be suitable. Additionally, the boundary 36 may be symmetric or asymmetric relative to the longitudinal midline 60. In general, the taper geometry influences both the engagement threshold at which banking initiates and the progression rate at which the banking angle develops under increasing lateral loads.

In addition to the taper, the dimensional characteristics of the midsole components may vary depending on the embodiment and performance objectives of the shoe. In some embodiments, the first zone 32 may have a thickness between 8 mm and 15 mm, though other thicknesses may be suitable depending on the specific application requirements. Additionally, the relative proportions of the first zone 32 and second zone 34 may vary along the length of the sole structure due to varying geometries of the boundary 36 between them. At its maximum extent, which occurs where the boundary 36 reaches its apex at or beyond the longitudinal midline 60, the second zone 34 may occupy between about 50% and about 70% of the total midsole width when measured from the medial edge 24'. This proportion decreases toward the forward and rear ends of the second zone 34, where the boundary curves back to meet the medial edge 24'.

Resilient Cushioning Member

The resilient cushioning member 30 spans at least a portion of both the first zone 32 and second zone 34 of the midsole 26 to create a continuous cushioning element that adapts to varying loading conditions. As noted above, the resilient cushioning member 30 comprises a sealed chamber formed of first and second polymeric sheets 38, 40 bonded together at the peripheral flange 42 to define an interior cavity containing pressurized fluid. The first and second polymeric sheets 38, 40 may be formed from materials including thermoplastic urethane, polyurethane, polyester polyurethane, polyether polyurethane, or combinations thereof. In some embodiments, the polymeric sheets 38, 40 may include one or more barrier layers formed from a copolymer of ethylene and vinyl alcohol (EVOH) to enhance fluid retention. The specific materials may be selected based on engineering properties including tensile strength, stretch characteristics, fatigue resistance, dynamic modulus, and loss tangent to achieve desired deformation and durability characteristics.

Material selection for the resilient cushioning member 30 may influence system performance characteristics in various embodiments. In some embodiments, the polymeric sheets 38, 40 may be formed from thermoplastic polyurethane having a Shore A hardness between 80 and 95, though other materials and hardness ranges may be suitable. Furthermore, the fluid within the resilient cushioning member 30 may be pressurized between about 10 PSI and about 25 PSI in certain embodiments, with the specific pressure potentially varying based on desired cushioning and response characteristics and may comprise a gas. These ranges represent example material specifications that may provide appropriate deformation characteristics while maintaining structural integrity throughout repeated loading cycles.

During straight-line running, these tensile elements 44 work in concert with the pressurized fluid to maintain a substantially planar configuration of the resilient cushioning member 30 across both the uniform first zone 32 and the tapered second zone 34 of the midsole 26. The tensile elements 44 manage the internal pressure distribution, preventing unwanted deformation when forces are primarily vertical.

When an athlete executes a lateral cutting movement, the region of the resilient cushioning member 30 overlying the second zone 34 deforms and/or compresses toward the midsole and/or the space created by the tapered geometry. The tensile elements 44 in this region maintain structural control while allowing prescribed displacement, effectively creating a functional banking angle through controlled deformation. This deformation progresses as lateral forces and contact pressure over the medial side 24 increase, with the resilient cushioning member 30 displacing further into the midsole/tapered zone to provide proportional support based on movement intensity. Additionally, in some embodiments, the compression of the resilient cushioning member 30 within the tapered region may result in a corresponding pressure increase of the fluid contained within the member 30.

The resilient cushioning member's return-to-neutral functionality stems from several coordinated mechanical properties. The pressurized chamber's natural tendency to maintain its original geometry provides a primary restoration force, enhanced by the tensile elements 44, which store energy during deformation and assist in returning the system to its neutral state. The presence of tensile elements 44 throughout the chamber ensures uniform force distribution during both deformation and recovery phases, preventing localized stress concentrations that could affect durability or performance.

Dynamic Banking

During straight-line running, force transmission follows a carefully controlled pathway through the sole structure 10. Vertical forces are distributed primarily through the first zone 32 of the midsole 26 and the resilient cushioning member 30, where the uniform thickness and substantially planar outer surface creates a stable platform for linear movement. During this straight-line running, the resilient cushioning member 30 maintains its substantially planar configuration through the balanced interaction of several mechanisms. The tensile elements 44 within the sealed chamber work to distribute internal pressure forces evenly across the chamber's volume, while the first and second polymeric sheets 38, 40 maintain their parallel orientation. This balanced force distribution prevents unwanted deformation even under significant vertical loads, with the resilient cushioning member 30 maintaining a deflection of less than about 2-4 mm from its unloaded planar configuration across its entire width.

When an athlete initiates a cutting movement, the system transitions through a progressive engagement sequence driven by the shift in the wearer's center of pressure 62 (as shown in FIGS. 3A-3C). As the athlete begins to change direction, their center of pressure 62 moves medially across the sole structure 10, creating an asymmetric loading pattern. Initially, when the center of pressure 62 is near the longitudinal midline 60, the ground contact remains primarily along the first zone 32. However, as the center of pressure 62 continues to shift medially, the loading becomes increasingly concentrated in the second zone 34 of the midsole 26. This concentrated loading on the second zone 34 causes the resilient cushioning member 30 to begin deforming within the tapered geometry.

The progression from neutral to banked position follows defined mechanical principles based on the location and magnitude of loading across the sole structure 10. Banking engagement initiates when the center of pressure 62 shifts sufficiently toward the medial side 24 (i.e., where the resilient cushioning member 30 protrudes beyond the tapered surface of the second zone 34). As medial loading increases, the protruding region of the resilient cushioning member 30 compresses progressively against the ground surface. This compression causes the sole structure 10 to begin tilting medially, which brings the tapered surface of the second zone 34 into increasing contact with the ground. The system achieves full banking engagement when the medially-concentrated load causes maximum compression of the protruding region of the resilient cushioning member 30, at which point a substantial portion of the tapered surface of the second zone 34 contacts the ground, establishing a defined banking angle relative to the first zone 32. This progressive ground contact pattern enables the sole structure 10 to provide increasing banking support proportional to the medial shift in center of pressure 62 during cutting movements.

The progression of ground contact during banking provides additional stability control throughout the cutting movement. As the sole structure transitions from neutral to banked positions, the ground contact pattern shifts from being predominantly along the first zone to increasingly engaging the tapered surface of the second zone. This progressive engagement creates a broader base of support during the cutting movement, with the ground contact area effectively increasing as the banking angle develops. The increasing ground contact helps stabilize the foot throughout the cutting movement while the tapered geometry maintains the desired banking response. By managing both the timing and extent of ground contact, the sole structure provides enhanced stability during the critical phase of foot rotation that occurs during cutting movements.

The return of the shoe to a more neutral position/posture similarly relies on a coordinated mechanical response of the system. As the center of pressure 62 shifts back laterally and vertical forces become more evenly distributed, the pressurized nature of the resilient cushioning member 30 provides an initial restoration force. Simultaneously, the geometric relationship between the first zone 32 and second zone 34 helps guide this return movement as ground contact transitions back to a neutral pattern.

Energy management within the system operates through an interplay of components. During lateral movement and subsequent banking, energy is temporarily stored in multiple ways: through compression of the midsole material in the second zone 34, through increased tension in the tensile elements 44 of the resilient cushioning member 30, and through the displacement and compression of pressurized fluid within the sealed chamber. As the athlete transitions back to straight-line movement and the center of pressure 62 returns laterally, this stored energy assists in returning the system to its neutral state. The pressurized nature of the resilient cushioning member 30 provides an initial restoration force similar to an air-spring, which is aided by the loading and unloading of the tensile elements 44 while constraining of the outer geometry of the polymeric sheets. This coordinated energy management enables efficient transitions between movement patterns while maintaining system stability throughout the entire activity cycle.

The sole system's ability to manage these transitions without abrupt changes in support characteristics represents an advancement in athletic footwear design. By carefully controlling the engagement and disengagement of the banking mechanism through the progressive ground contact pattern, the sole structure 10 provides enhanced support during lateral movements while maintaining optimal biomechanical alignment during straight-line running, all without requiring conscious adaptation by the athlete.

EXAMPLES

Figure 4C:
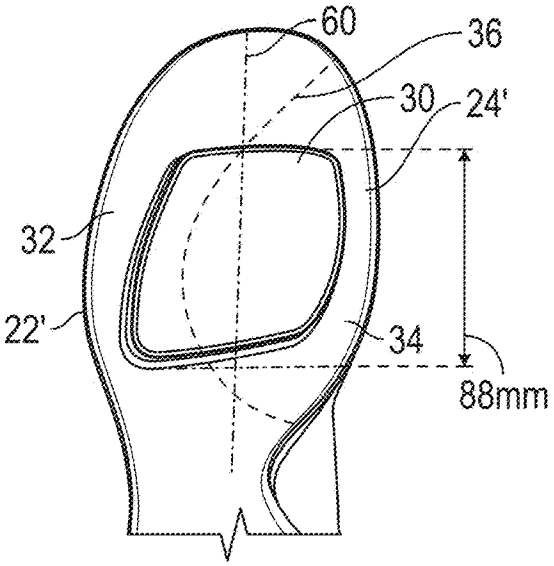
FIGS. 4A-4C illustrate schematic plan views of three embodiments of the sole structure incorporating different resilient cushioning member configurations; in these configurations.
Figure 4B:
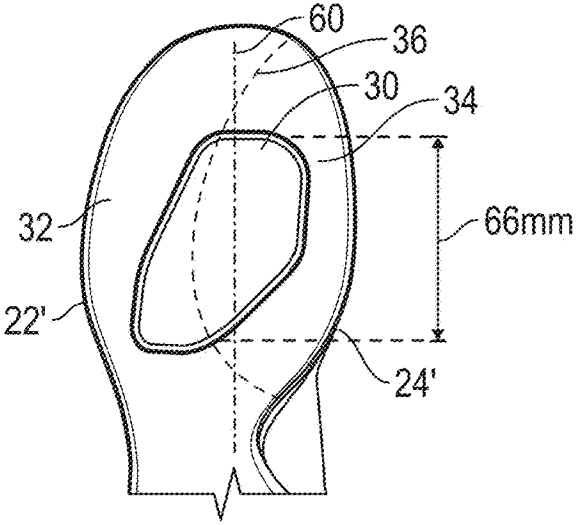
Figure 4A:
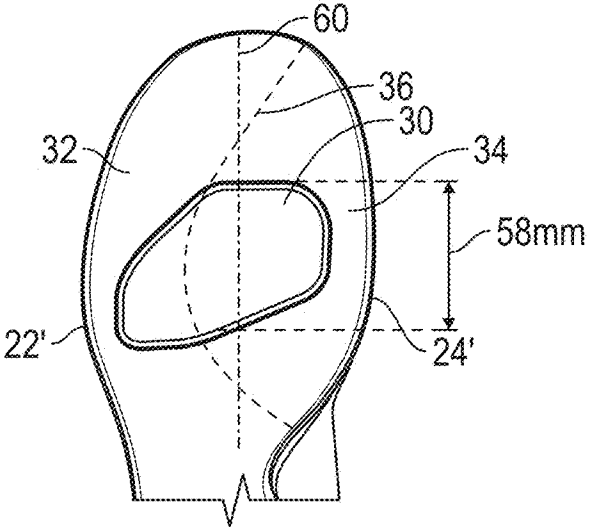

FIGS. 4A-4C provide three embodiments of the sole structure 10, each implementing a different configuration of the dynamic banking system while maintaining a consistent midsole geometry. In each embodiment, the second zone 34 is defined by an arcuate boundary 36 that begins at the medial edge 24', extends laterally beyond the longitudinal midline 60 to reach an apex, and returns to the medial edge 24'. This arcuate boundary 36 delineates a region where the midsole material has been "removed" to create a substantially constant taper angle of approximately 7 degrees when measured at the horizontal midline. The embodiments differ primarily in the configuration and exposure of the resilient cushioning member 30 within this tapered region, producing varying dynamic responses while maintaining the fundamental operational principles of the banking mechanism.

A first embodiment, shown in FIG. 4A, incorporates a configuration wherein the resilient cushioning member 30 has a relatively narrow longitudinal width of about 58 mm measured parallel to the longitudinal midline 60. During testing, this configuration demonstrated the quickest banking response to medial weight transfer, initiating cambering at lower lateral force thresholds compared to the other embodiments. This enhanced banking sensitivity may be attributed to the smaller volume of exposed resilient cushioning member 30 requiring less air displacement for deformation, as well as the narrower longitudinal profile providing reduced support beneath the toes during medial weight shifts.

A second embodiment, shown in FIG. 4B, implements an intermediate configuration wherein the resilient cushioning member 30 extends about 66 mm in width measured parallel to the longitudinal midline 60. Testing revealed this arrangement provided a more balanced response, requiring moderate lateral forces to initiate banking while maintaining consistent support throughout the foot's range of motion. The broader longitudinal profile of the resilient cushioning member 30 creates a more progressive engagement of the banking mechanism compared to the first embodiment.

A third embodiment, shown in FIG. 4C, implements a configuration wherein the resilient cushioning member 30 extends about 88 mm in width measured parallel to the longitudinal midline 60. Despite having the largest exposure of the resilient cushioning member 30, testing demonstrated this configuration provided the highest resistance to cambering, requiring greater lateral forces to initiate banking compared to the other embodiments. This enhanced stability may be attributed to the larger volume of exposed resilient cushioning member 30 requiring greater air displacement to achieve deformation, as well as the broader longitudinal profile providing more consistent support across the foot platform.

The extent to which the resilient cushioning member 30 protrudes beyond the midsole material varies systematically across these embodiments, contributing to their distinct performance characteristics. The relationship between resilient cushioning member exposure and banking response appears to be influenced by multiple factors including the volume of exposed resilient cushioning member material, the longitudinal width of the resilient cushioning member 30, and the interaction between the resilient cushioning member 30 and the foot platform during dynamic loading conditions.

In general, the width of the resilient cushioning member 30, measured parallel to the longitudinal midline 60, may be between about 50 mm and 100 mm or between about 58 mm and about 88 mm. In these examples, the taper angle remains substantially constant at all points within the second zone 34 along the longitudinal dimension (i.e., the taper angle at the forward-most point approximates the taper angle at the rear-most point as well as the taper at a mid-point between these extremes). Alternative embodiments may implement varying taper angles along the longitudinal dimension, for example, providing the greatest taper angle at a midpoint of the second zone 34 with comparatively shallower angles at the forward-most and rear-most points. Such design variations may be selected to adapt performance to specific motion patterns, sporting requirements, or individual player characteristics.

The variation between embodiments demonstrates how modifications to the resilient cushioning member configuration produce corresponding changes in performance characteristics. The first embodiment's narrow profile creates enhanced banking sensitivity while potentially sacrificing some stability. The second embodiment's intermediate geometry achieves a balance between banking responsiveness and consistent support. The third embodiment's extensive coverage maximizes stability while requiring greater forces to initiate banking.

Each embodiment represents a specific implementation of the dynamic banking system adapted to different performance requirements through systematic variation of the resilient cushioning member configuration. The first embodiment's enhanced banking response suits applications prioritizing quick directional transitions. The second embodiment's balanced configuration provides intermediate performance characteristics suitable for general use cases. The third embodiment's stability-focused configuration suits applications requiring maximum support during aggressive cutting movements. This range of embodiments demonstrates how the fundamental principles of dynamic banking may be implemented through varying resilient cushioning member configurations while maintaining consistent midsole geometry across all versions.

While specific dimensional values are provided for these embodiments, it should be understood that these values represent example implementations, and variations of these dimensions may be employed while maintaining the fundamental principles described herein. The systematic variation between embodiments demonstrates the scalability of the dynamic banking system across different geometric configurations.

As used throughout this disclosure, certain terms are used with specific meanings to describe various aspects of the sole structure 10. The term "substantially uniform thickness" as applied to the first zone 32 refers to a region maintaining consistent dimensional characteristics within ±0.5 mm of the specified thickness value across its defined extent though ignores the presence of sipes, grooves, or traction elements provided on the outsole. A "controlled medial deformation" describes a systematic angular displacement of the resilient cushioning member 30 between 5 and 9 degrees occurring in response to applied lateral forces, with this deformation progressing proportionally to the magnitude of lateral loading and/or shifts in contact pressure. The term "banking angle" defines the measurable angle formed between a neutral or upper surface of the sole structure and a ground-plane that results during lateral loading conditions.

As used herein with respect to any disclosed values or ranges, the term "about" indicates that the stated numerical value allows for slight imprecision, e.g., reasonably close to the value or nearly, such as ±10 percent of the stated values or ranges. If the imprecision provided by the term "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range.

The invention claimed is:

1. A sole structure, comprising:

a midsole having a lateral side defining a lateral edge and a medial side defining a medial edge, the midsole including:

a first zone extending from the lateral edge toward the medial side and having a substantially uniform thickness, and a second zone extending from the medial edge toward the first zone and having a tapered thickness that decreases toward the medial edge; and a resilient cushioning member extending across a portion of both the first zone and the second zone of the midsole in at least a forefoot region of the sole structure, wherein:

the resilient cushioning member is substantially inset within the midsole in the first zone, the resilient cushioning member protrudes increasingly from the midsole in the second zone as the tapered thickness decreases toward the medial side, and the resilient cushioning member maintains a substantially planar configuration when unloaded and permits controlled medial deformation of between 5 and 9 degrees when laterally loaded.

2. The sole structure of claim 1, wherein the second zone defines an outer surface having a taper angle relative to an outer surface of the first zone.

3. The sole structure of claim 2, wherein the taper angle is between 5 and 9 degrees.

4. The sole structure of claim 1, wherein the resilient cushioning member comprises:

a sealed chamber containing pressurized fluid;

first and second polymeric sheets defining the sealed chamber; and a plurality of tensile elements connecting the first and second polymeric sheets across the sealed chamber.

5. The sole structure of claim 1, wherein the second zone includes a taper zone having a length between 25 mm and 45 mm measured from the medial edge toward the lateral side.

6. The sole structure of claim 1, further comprising an outsole, wherein the outsole extends continuously across the first zone and a portion of the resilient cushioning member, and wherein the outsole is discontinuous across the second zone to accommodate the protruding resilient cushioning member.

7. The sole structure of claim 1, wherein the second zone is defined by a continuous boundary extending from a first point on the medial edge to a second point on the medial edge, the boundary extending laterally beyond a longitudinal midline of the sole structure between the first and second points.

8. The sole structure of claim 1, wherein the first zone extends from the lateral edge to at least a longitudinal midline of the midsole.

9. The sole structure of claim 1, wherein the second zone comprises between 50% and 70% of a total width of the midsole measured from the medial edge.

10. The sole structure of claim 1, wherein the resilient cushioning member is configured to compress against a ground surface in the second zone when a center of pressure shifts medially during a lateral cutting movement.

11. An article of footwear, comprising:

an upper; and a sole structure attached to the upper, the sole structure including:

a midsole having a lateral portion with a first thickness and a medial portion with a tapered thickness that decreases toward a medial edge of the midsole; and a resilient cushioning member spanning a portion of both the lateral portion and the medial portion, wherein:

the resilient cushioning member is substantially inset within the midsole in the lateral portion, the resilient cushioning member protrudes increasingly from the midsole in the medial portion, and the resilient cushioning member is configured to maintain a substantially neutral position during straight-line motion and permit medial deformation during lateral movement to create a dynamic banking angle.

12. The article of footwear of claim 11, wherein the resilient cushioning member comprises:

a sealed chamber containing pressurized fluid;

first and second polymeric sheets defining the sealed chamber; and a plurality of tensile elements connecting the first and second polymeric sheets across the sealed chamber and configured to maintain the substantially neutral position when evenly loaded.

13. The article of footwear of claim 11, wherein the dynamic banking angle is between 5 and 9 degrees relative to a horizontal ground plane when the resilient cushioning member compresses in the medial portion during lateral loading.

14. The article of footwear of claim 11, wherein:

the medial portion includes a taper zone having a width of between about 50 mm and about 100 mm, wherein the width is measured parallel to a longitudinal midline of the sole structure; and the resilient cushioning member protrudes beyond the midsole by a progressively increasing distance through the taper zone.

15. The article of footwear of claim 11, wherein:

the resilient cushioning member extends proud of the midsole along the medial side; and the proud extension enables initial compression of the resilient cushioning member against a ground surface when a center of pressure of a wearer's foot shifts medially.

16. The article of footwear of claim 11, wherein the medial portion having the tapered thickness is defined by a continuous boundary that begins at a first location on the medial edge, extends laterally beyond a longitudinal midline of the sole structure, and terminates at a second location on the medial edge, and wherein the tapered thickness provides a substantially constant slope when measured in a plane perpendicular to the longitudinal midline.

17. The article of footwear of claim 11, wherein:

the medial portion comprises between 50% and 70% of a total width of the midsole measured from a medial edge to the lateral side; and the resilient cushioning member maintains the substantially neutral position when a center of pressure of a wearer's foot is laterally centered and permits the dynamic banking angle when the center of pressure of the wearer's foot shifts medially beyond a threshold proportion of the total width.

18. The article of footwear of claim 11, wherein the resilient cushioning member is configured to:

provide vertical cushioning while maintaining the substantially neutral position during straight-line motion when loading is substantially vertical; and provide combined vertical cushioning and banking during lateral movement when loading includes both vertical and medial components.

19. The article of footwear of claim 11, wherein the tapered thickness of the medial portion is configured such that, during a lateral cutting movement, ground contact progressively increases from initial contact with the protruding resilient cushioning member to subsequent contact with the tapered surface of the medial portion.

20. The article of footwear of claim 11, wherein compression of the protruding portion of the resilient cushioning member against the ground surface is initiated by a medial shift in a center of pressure of a wearer's foot during a cutting movement.

* * * * *